United States Patent [19]

Hansen

[11] Patent Number: 4,963,080

[45] Date of Patent: Oct. 16, 1990

[54] ROTARY HYDRAULIC VANE MACHINE WITH CAM-URGED FLUID-BIASED VANES

[75] Inventor: Lowell D. Hansen, Jackson, Miss.

[73] Assignee: Vickers, Incorporated, Troy, Mich.

[21] Appl. No.: 314,884

[22] Filed: Feb. 24, 1989

[51] Int. Cl.[5] ..... F04C 15/00

[52] U.S. Cl. ..... 418/260; 418/268

[58] Field of Search ..... 418/259, 260, 268, 263, 418/223

[56] References Cited

U.S. PATENT DOCUMENTS

| | | | |
|---|---|---|---|
| 440,120 | 9/1890 | Forsythe | 418/223 |
| 1,666,466 | 4/1928 | Peters | 418/260 |
| 2,330,565 | 9/1943 | Eckhart | 418/260 |
| 3,632,238 | 1/1972 | Searle | 418/15 |
| 4,386,891 | 6/1983 | Riefel et al. | 418/269 |
| 4,408,964 | 10/1983 | Mochizuki et al. | 418/259 |

FOREIGN PATENT DOCUMENTS

| | | | |
|---|---|---|---|
| 3528139 | 2/1987 | Fed. Rep. of Germany | 418/260 |

*Primary Examiner*—John J. Vrablik
*Assistant Examiner*—David L. Cavanaugh
*Attorney, Agent, or Firm*—Barnes, Kisselle, Raisch, Choate, Whittemore & Hulbert

[57] ABSTRACT

A rotary vane-type hydraulic fluid flow divider in which a rotor is mounted on a stub shaft for free rotation within a housing. A plurality of vanes are individually slidably mounted in radial slots on the rotor and engages a surrounding cam ring to form fluid cavities. A pair of cam plates are mounted in fixed position with respect to the cam ring and have radially orientated surfaces that engage the vanes and position the vanes adjacent to the cam ring. The fluid cavities communicate with a common inlet and a pair of outlets for dividing inlet fluid flow between the outlets.

5 Claims, 2 Drawing Sheets

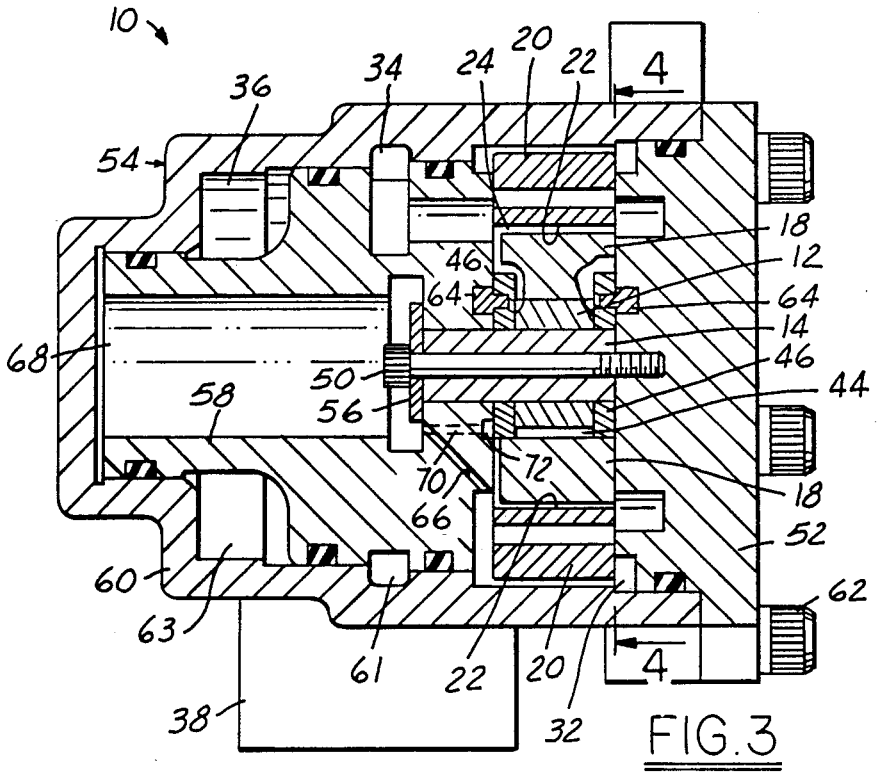
FIG.3
FIG.4
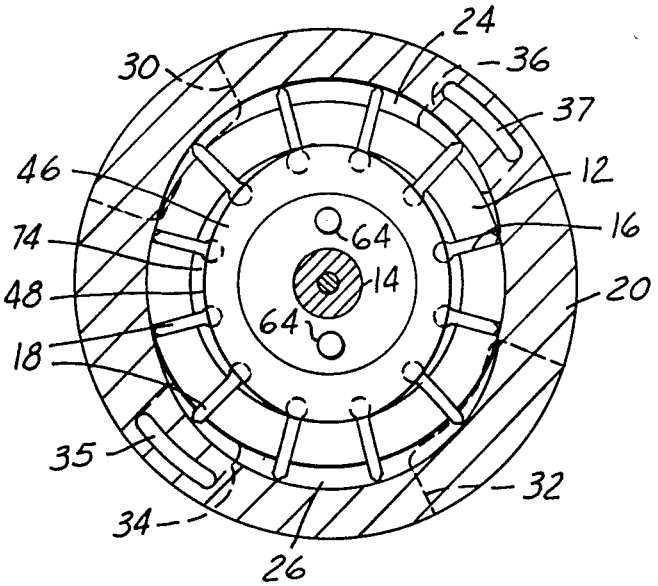

ROTARY HYDRAULIC VANE MACHINE WITH CAM-URGED FLUID-BIASED VANES

The present invention is directed to rotary hydraulic machines, and particularly to sliding-vane type machines capable of functioning as hydraulic pumps and motors.

BACKGROUND AND OBJECTS OF THE INVENTION

Rotary hydraulic machines of the subject type generally include a housing, a rotor mounted for rotation with in the housing and having a plurality of radially extending peripheral slots, and a plurality of vanes individually slidably mounted in the slots. A cam ring surrounds the rotor and has a radially inwardly directed surface forming a vane track and one or more fluid pressure cavities between the cam surface and the rotor. Inlet and outlet passages feed hydraulic fluid to and from the cavities.

It is necessary in operation of machines of this character that the rotor vanes slidably engage the opposing cam ring surface. During operation, the vanes are urged outwardly against the cam ring surface by centrifugal force. However, there are many conditions existing and forces created tending to prevent the vanes from acting freely as cam ring surface followers, and also causing the vanes to collapse or retract from the vane track, such as both mechanical and viscous friction, bearing loads of the vanes against the track or between the vane and rotor, and differential pressures creating unfavorable resultant forces acting on the extreme inner or outer edges of the vanes. Further, upon initial operation of the machine, it is undesirable to permit the vanes to be spaced from the opposing cam ring surface, both because of pressure loss as fluid freely flows over the vanes, and also because centrifugal forces can cause the vanes to be damaged by impact against the cam ring surface.

To overcome the aforementioned problems, it has heretofore been proposed to form chambers in the rotor beneath the vane slots. Springs are positioned within these rotor chambers and/or fluid is fed under pressure to the rotor chambers for urging the vanes radially outwardly against the cam ring surface. The vane springs, where employed, exhibit varying spring rate both among individual springs and over the operating life of a given spring, possess a limited operating life, and frictionally wear against the opposing edges of the vanes. Provision of undervane fluid pressure, either intermittent or continuous, usually requires the use of valves for feeding the fluid to the undervane chambers prior to the primary machine cavities, and also does not overcome the problem of vane impact against the cam ring surface except where combined with the vane springs. So-called inner vane machines have addressed but not entirely overcome the problems in question.

One object of the present invention, therefore, is to provide a rotary hydraulic machine of the subject character that includes facility ensuring that the vanes are continually positioned adjacent to the cam ring surface, while overcoming the aforementioned deficiencies in the art. Another and related object of the invention is to provide a rotary hydraulic machine of the described character that overcomes the aforementioned deficiencies in the art, that continually positions the vanes adjacent to the cam ring surface while reducing frictional wear, and that is less expensive to manufacturer than are prior art machines of similar type.

Another problem addressed by the present invention lies in the provision of hydraulic apparatus for dividing a single input flow of hydraulic fluid into two or more output flows at a predetermined flow ratio. Prior art devices for this purpose have involved relatively complex and expensive specialized structures. Yet another object of the present invention, therefore, is to provide a hydraulic fluid flow divider that is inexpensive to manufacture and assemble, and that is reliable over an extended operating lifetime.

SUMMARY OF THE INVENTION

The present invention contemplates a vane-type rotary hydraulic machine that comprises a housing, a rotor mounted within the housing and having a plurality of radially extending peripheral slots, and a plurality of vanes individually slidably mounted in the rotor slots. A cam ring within the housing surrounds the rotor and has a radially inwardly directed surface forming a track for sliding engagement with the vanes, and at least one fluid pressure cavity between the cam ring surface and the rotor. Fluid inlet and outlet passages in the housing are coupled to the pressure cavity.

In accordance with a first aspect of the present invention that is useful in pumps, motors and other vane-type machines of the subject character, a cam mechanism is mounted with the housing in fixed position with respect to the cam ring and has a surface for engaging the radially inner edges of the vanes to position the radially outer vane edges adjacent to the cam ring surface. In the preferred embodiment of the invention, such cam mechanism takes the form of a pair of cam plates having continuous radially orientated surfaces contoured substantially identically to the cam ring surface and spaced radially inwardly therefrom by a distance corresponding to, and preferably slightly greater than, the radial dimension of the rotor vanes. The cam plates are carried by the housing and positioned in cylindrical pockets formed in the opposed axially outwardly facing surfaces of the rotor. Thus, the cam plates uniformly engage the inner edges of the vanes at axially spaced positions. Further, in the preferred embodiment of the invention, fluid pressure chambers are formed in the rotor beneath the vane slots, so that fluid pressure urges the vanes against the cam ring surface during normal operation while lifting the vanes from the cam plate surfaces, thereby eliminating frictional contact and wear between the vanes and the cam plates surfaces.

In accordances with a second aspect of the present invention, the rotor is mounted for free rotation within the housing on a stub shaft completely enclosed by the housing. The rotor and cam ring form at least two fluid pressure cavities, preferably two cavities radially symmetrically positioned with respect to the stub shaft. The machine thus forms a vane-type flow divider for dividing an input flow of hydraulic fluid under pressure into two output flows at a predetermined flow ratio, specifically at a 1:1 ratio in the preferred embodiment of the invention. Pressure drop between the inlet and outlets is greatly reduced as compared with prior art devices for a similar purpose.

BRIEF DESCRIPTION OF THE DRAWINGS

The invention, together with additional objects, features and advantages thereof, will be best understood from the following description, the appended claims and the accompanying drawings in which:

FIG. 3 is a sectional view taken substantially along the line 3—3 in FIG. 2; and FIG. 4 is a sectional view taken substantially along the line 4—4 in FIG. 3

DETAILED DESCRIPTION OF PREFERRED EMBODIMENT

Figure 1:
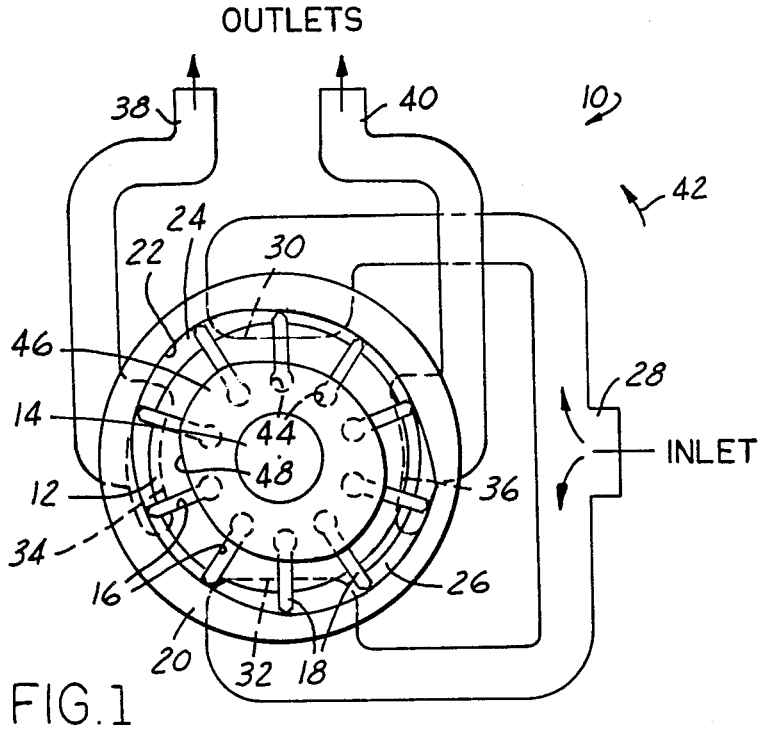
FIG. 1 is a schematic diagram of a vane-type hydraulic fluid flow divider in accordance with a presently preferred embodiment of the invention.

FIG. 1 schematically illustrates a balanced dual-lobe vane-type rotary hydraulic machine 10 as comprising a rotor 12 rotatable mounted on a shaft 14. Rotor 12 has a circular periphery and a circumferential array of radially directed slots 16 in which a corresponding plurality of vanes 18 are radially slidably disposed. A cam ring 20 radially surrounds rotor 12, and has a radially inwardly directed cam ring surface 22 that cooperates with rotor 12 and vanes 18 to form a pair of diametrically opposed fluid cavities 24, 26. Hydraulic fluid is fed from an inlet 28 to a pair of inlet ports 30, 32 in communication with cavities 24, 26, and the respective cavities also communicate through outlet ports 34, 36 and cross-over passages 35, 37 with the respective fluid outlets 38, 40. A chamber 44 is formed in rotor 12 beneath each slot 16 and communicates with ports 30, 32 so that hydraulic fluid pressure urges vanes 18 radially outwardly against surface 22 of cam ring 20. To the extent thus far described (with the exception of separate outlets 38, 40), machine 10 is of generally conventional construction, and can operate either as a pump, in which rotor 12 is driven in the direction 42 by shaft 14 to pump fluid from low pressure inlet 28 to high pressure outlets 38, 40, or as a motor in which flow of fluid from high pressure inlet 28 to low pressure outlets 38, 40 drives rotor 12 and shaft 14 in the direction 42.

In accordance with a first important aspect of the present invention, a cam plate 46 (FIG. 1) is mounted in fixed position relative to cam ring 20 surrounding shaft 14. Cam plate 46 has a radially outwardly directed edge surface 48 that engages the radially inner edges of vanes 18 and is substantially identical in contour to the opposing surface 22 of cam ring 20. Cam plate surface 48 is spaced from cam ring surface 22 by a distance slightly greater than the radial dimension of vanes 18. Thus, cam plate 46 positions vanes 18 radially adjacent to surface 22 of cam ring 20 at all positions of rotor 12. The vanes are thus automatically positioned to substantially seal cavities 24, 26 upon initial operation of machine 10, and minimize travel of vanes 18 into radial impact with cam ring surface 22 as fluid pressure is supplied to chambers 44. However, when fluid pressure is applied to chambers 44, such fluid pressure urges vanes 18 against cam ring surface 22 so that the vane inner edges are spaced from surface 48 of cam plate 46, thereby reducing sliding friction and wear between the vanes and the cam plate surface. In accordances with a second important aspect of the present invention, rotor 12 is not rotatably coupled to shaft 14, but rather freely rotates with respect thereto, while shaft 14 is completely enclosed within the surrounding housing. Thus, machine 10 forms a flow divider for dividing input fluid flow at inlet 28 into separate output flows at outlets 38, 40.

Figure 2:
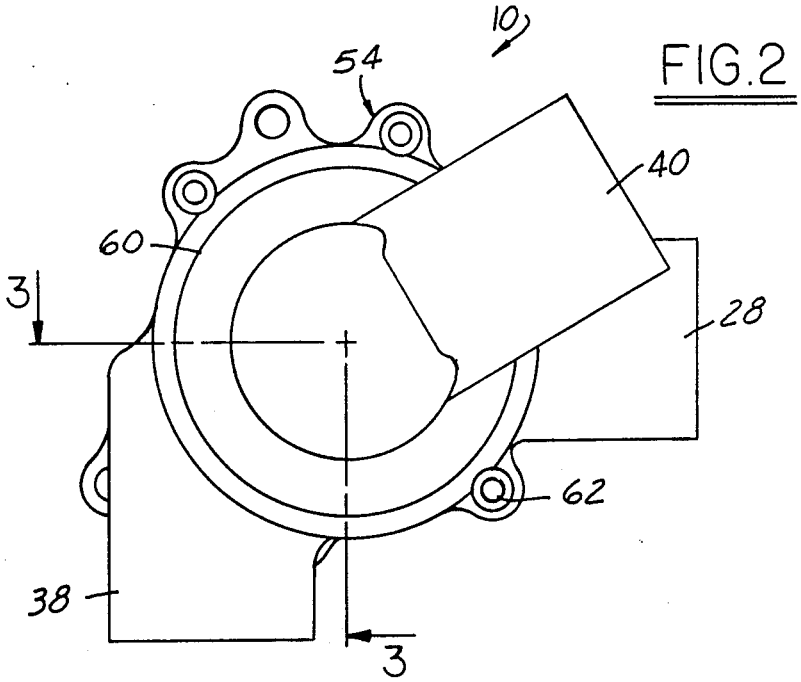
FIG. 2 is an end elevational view of a flow divider in accordance with the invention.

FIGS. 2–4 illustrate a presently preferred embodiment of rotary hydraulic fluid flow divider 10. Reference numerals in FIGS. 2–4 identical to those employed in the schematic diagram of FIG. 1 indicate corresponding elements. Rotor 12 is freely rotatably mounted on stub shaft 14, which is affixed by a bolt 50 to the cover plate 52 of machine housing 54. A washer 56 cooperates with bolt 50 to capture a backup plate 58, with cam ring 20 being sandwiched between backup plate 58 and cover plate 52 to form the rotor cavity. Backup plate 58 and cam ring 20 are surrounded by a cup-shaped casing 60 that is affixed by bolts 62 to cover plate 52 to complete housing 54. Separate annular cavities 61, 63 are formed between casing 60 and plate 58 to feed the respective output flows to outlets 38, 40. Cover plate 52 and backup plate 58 have axially opposed flat surfaces that face opposing axially outwardly orientated flat surfaces of rotor 12. A cam plate 46 is mounted on the rotor-facing surface of each plate 52, 58 and is held thereon by the pins 64. Each cam plate is thus positioned in a substantially cylindrical pocket 74 (FIG. 4) in the opposing rotor surface, with the outer edge surface 48 of each cam plate 46 engaging the opposing inner edges of vanes 18 as previously described.

Inlet 28 (FIGS. 1 and 2) communicates with ports 30, 32 as previously described, and thence through a passage 66 (FIG. 3) to a sealed cavity 68 in backup plate 58. A passage 70 extends from cavity 68 to an annular channel 72 on the rotor-opposing face of backup plate 58 to form a hydraulic clamp mechanism to hold backup plate 58 to cam ring 22 to end cover 52. Channel 72 is at a radius from the axis of rotation of rotor 12 corresponding to the radial position of fluid chambers 44, and thus feeds fluid at substantially inlet pressure to rotor chambers 44 for urging vanes 18 radially outwardly against cam ring surface 22.

The invention claim is:

1. A rotary hydraulic machine that comprises:

a housing, a rotor mounted for rotation within said housing, said rotor having a plurality of radially extending peripheral slots and a fluid pressure chamber at a radially inner edge of said slot, a plurality of vanes individually slidably mounted in said slots, means forming a cam ring within said housing surrounding said rotor and having a radially inwardly directed surface forming a vane track and at least one fluid pressure cavity between said surface and said rotor, fluid inlet and outlet means in said housing coupled to said at least one cavity, cam means mounted within said housing in fixed position within said cam ring, said cam means having radially outwardly oriented cam surface means of continuous contour substantially identical to contour of said cam ring surface, said cam surface means being position to engage said vanes so as to position radially outer edges of said vanes adjacent to but spaced from said cam ring surface, and means in said housing for feeding fluid under pressure to said rotor chambers so as to lift said vanes from said cam surface means and urge said vanes against said cam ring surface, such that said vanes are normally urged against said cam ring surface and spaced from said cam surface means by fluid pressure in said chambers while said cam surface means limits radially inward motion of said vanes in the event of fluctuation or loss of fluid pressure in said chambers.

2. The machine set forth in claim 1 wherein all of said vanes have a predetermined radial dimension identical to each other, and wherein said cam surface means is spaced from said cam ring surface by a substantially uniform distance that is slightly greater than said radial dimension of said vanes.

3. The machine set forth in claim 1 wherein said rotor has a substantially flat side face and a pocket formed in said side face, wherein said housing includes means forming a substantially flat face opposed to said rotor side face, and wherein said cam means comprise a flat cam plate affixed to said housing and positioned in said pocket.

4. The machine set forth in claim 1 wherein said rotor has a pair of substantially flat side faces each having a substantially circular axially outwardly opening pocket formed therein, wherein said housing includes means forming substantially flat faces opposed to said side faces, and wherein said cam means comprises a pair of substantially identical cam plates affixed to said housing and positioned in respective ones of said pockets for balanced engagement with said radially inner edges of said vanes.

5. The machine set forth in claim 4 wherein said cam plates comprise members separate from said housing mounted to said substantially flat faces of said housing.

* * * * *